US005656793A

United States Patent [19]

Ochi et al.

[11] Patent Number: 5,656,793

[45] Date of Patent: Aug. 12, 1997

[54] GAS GENERATOR COMPOSITIONS

[75] Inventors: Koji Ochi; Nobukazu Asano, both of Aichi-ken; Kenji Harada, Handa; Keiji Sakumoto, Aichi-ken, all of Japan

[73] Assignee: Eiwa Chemical Ind. Co., Ltd., Kyoto, Japan

[21] Appl. No.: 586,407

[22] Filed: Jan. 16, 1996

Related U.S. Application Data

[63] Continuation-in-part of Ser. No. 434,446, May 3, 1995, abandoned.

[30] Foreign Application Priority Data

May 9, 1994 [JP] Japan ..... 6-95194
Nov. 15, 1994 [JP] Japan ..... 6-280801

[51] Int. Cl.[6] ..... C06B 23/04; C06B 29/02

[52] U.S. Cl. ..... 149/22; 149/36; 149/37; 149/61; 149/75; 149/108.2

[58] Field of Search ..... 149/19.1, 22, 36, 149/37, 42, 43, 61, 77, 108.2, 75

[56] References Cited

U.S. PATENT DOCUMENTS

| | | | |
|---|---|---|---|
| 3,662,802 | 5/1972 | Bedell | 149/36 |
| 3,839,105 | 10/1974 | DeWitt et al. . | |
| 4,138,282 | 2/1979 | Goddard et al. | 149/19.8 |
| 4,948,439 | 8/1990 | Poole et al. | 149/46 |
| 5,125,684 | 6/1992 | Cartwright | 280/736 |
| 5,380,380 | 1/1995 | Poole et al. | 149/22 |
| 5,386,775 | 2/1995 | Poole et al. | 102/289 |
| 5,431,103 | 7/1995 | Hock et al. | 102/287 |
| 5,467,715 | 11/1995 | Taylor et al. | 102/289 |
| 5,531,845 | 7/1996 | Flanigan et al. | 149/109.6 |

FOREIGN PATENT DOCUMENTS

| | | |
|---|---|---|
| 0 607 446 A1 | 7/1994 | European Pat. Off. . |
| 0 607 450 A1 | 7/1994 | European Pat. Off. . |
| 2 063 586 | 7/1971 | Germany . |
| WO95/00462 | 1/1995 | WIPO . |

*Primary Examiner*—Christine Skane
*Assistant Examiner*—John R. Hardee
*Attorney, Agent, or Firm*—Vidas, Arrett & Steinkraus, P.A.

[57] ABSTRACT

A gas generator contains hydrazodicarbonamide serving as a reducing agent, oxoacid salt serving as an oxidizing agent, and a combustion controller which is catalytic or combustible. As a combustible combustion controller, boron, and zirconium are preferred. The gas generator includes a flame coolant containing at least one compound selected from the group consisting of hydrates of metal sulfates, hydrates of metal nitrates, hydrates of metal carbonates, metal hydroxides, and hydrates of metal hydroxides in which the metal moieties are selected from the III, IV, V, and VI Period metal of the Periodic Table. As a flame coolant, magnesium hydroxide is preferred.

10 Claims, 1 Drawing Sheet

GAS GENERATOR COMPOSITIONS

This application is a continuation in part application of the U.S. Pat. application Ser. No. 08/434,446 filed on May 3, 1995 entitled GAS GENERATOR COMPOSITIONS.

BACKGROUND OF THE INVENTION

1. Field of the Invention

The present invention relates to a gas generator composition used in a gas generating apparatus for inflating an air bag.

2. Description of the Related Art

Air bags are often used as a device in automobiles to protect the automobile's occupants in case of a collision. When used for this purpose, the air bag is often attached to the steering wheel in the automobile passenger compartment and operates by generating gas to inflate a bag between the steering wheel and the driver. Conventional gas generators primarily contain sodium azide and various types of oxidizing agents as primary chemical agents. When burned, these agents generate nitrogen gas that inflates the air bag. The particular apparatus used to inflate the air bag is known as a gas generator container.

Because sodium azide when burned generates clean nitrogen gas, it has become a popular choice as the primary chemical agent for gas generators. Unfortunately, sodium azide is highly toxic and easily forms unstable volatile substances, when exposed to acids or heavy metal. Consequently, special care must be taken in the handling of sodium azide both during its production and after it is spent generating gas. Moreover, gas generators with sodium azide as a primary chemical agent, produce large amounts of corrosive residues such as sodium and sodium compounds. These substances should ideally be neutralized before being discarded.

In order to avoid these problems, efforts have been made to produce gas generators that contain no sodium azide. For example, Japanese Patent Publication No. 20919/1983 discloses a gas generator comprising the following three components: (1) 78 to 92% by weight of a chlorate or perchlorate of an alkali metal or of an alkaline earth metal as an oxidizing agent; (2) 7.9 to 17.2% by weight of cellulose acetate and (3) 0.1 to 0.8% by weight of acetylene black or graphite as a carbon-containing combustion controller. This type of gas generator generates about 0.36 lit/g of gas, that under typical conditions contains includes water, carbon dioxide, oxygen and virtually no carbon monoxide.

Unfortunately, the gas generator composition described in the 20919/1983 publication has a very high combustion temperature. When the composition as described in this publication burns in a gas generator container, the gasses produced must be thoroughly cooled to prevent the air bag from burning. Consequently, a large amount of cooling agent must be provider in the gas generator container. This requirement inhibits efforts to make smaller sized gas generators.

Alternatively, Japanese Patent Publication No. 57150/1982 discloses a gas generator similar to the 20919/1983 publication, but contains azodicarbonamide (hereinafter referred to as ADCA) and an oxohalogeno acid salt.

The composition of this gas generator produces a large volume of gas, but is unstable at low temperatures.

Generally, the amount of the gas generator required per gas generator container can be reduced by increasing the amount of gas generated per unit weight of the gas generator.

This presents a straight forward technique to reduce the size and weight of gas generator containers. Present efforts to achieve size and weight reduction of gas generators, however, have yet to take full advantage of this technique.

SUMMARY OF THE INVENTION

Accordingly, it is a primary objective of the present invention to provide a gas generator which contains no sodium azide and generates substantially no toxic carbon monoxide.

It is another objective of the present invention to provide a gas generator capable of generating a large volume of gas from a small amount of gas generator material, in order not only to reduce the amount of gas generator material needed for operation, but also to reduce the size and weight of the gas generator container.

It is a further objective of the present invention to provide a gas generator having a low combustion temperature, in order to further reduce the amount of needed gas generator as well as to further reduce the size and weight of the gas generator container.

A further objective of the present invention is to provide a gas generator which increases the reaction rate of a reducing agent and an oxidizing agent while improving the combustion rate and stabilizing combustion.

Another objective of the present invention is to provide a gas generator capable of maintaining a balance between an increase in combustion rate and a decrease in combustion temperature.

Still, another objective of the present invention is to provide a gas generator which raises the initial decomposition temperature, has superior heat stability, and may be handled with ease.

BRIEF DESCRIPTION OF THE DRAWING

The features of the present invention that are believed to be novel are set forth with particularity in the appended claims. The invention, together with the objects and advantages thereof, may best be understood by reference to the following description of the presently preferred embodiments taken in conjunction with the accompanying drawings in which:

DETAILED DESCRIPTION OF THE PREFERRED EMBODIMENTS

Figure 1:
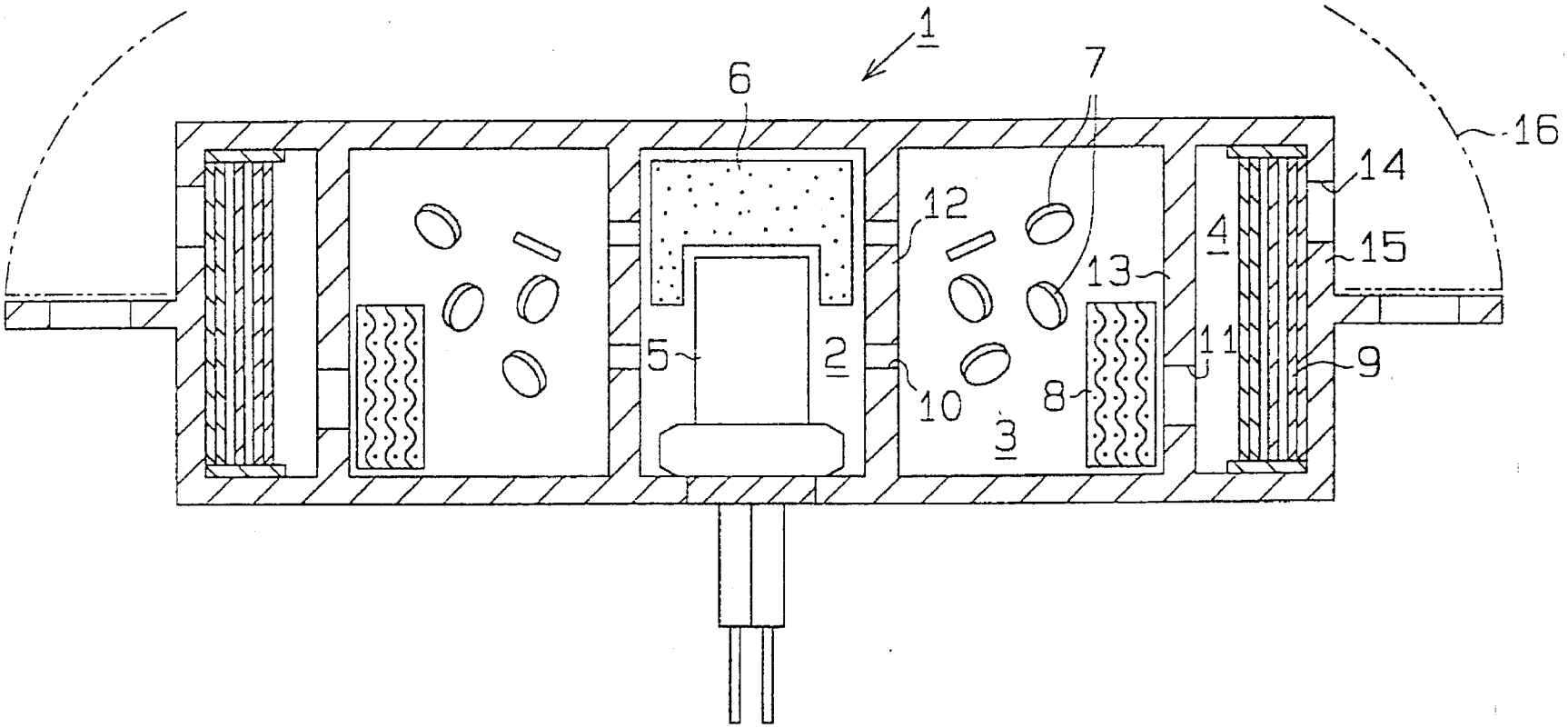
FIG. 1 illustrates in cross-sectional view a gas generator container containing the gas generator according to one embodiment of the present invention.

First, a description will be given of a case where the gas generator contains hydrazodicarbonamide (hereinafter referred to as HDCA) as a reducing agent and an oxoacid salt as an oxidizing agent.

HDCA is a reducing compound consisting of carbon, nitrogen, hydrogen and oxygen, represented by the following chemical formula (1):

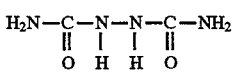

$$H_2N-\underset{\underset{O}{\|}}{C}-\underset{\underset{H}{|}}{N}-\underset{\underset{H}{|}}{N}-\underset{\underset{O}{\|}}{C}-NH_2 \quad (1)$$

When HDCA is burned with an oxidizing agent, large amounts of carbon dioxide, water, nitrogen and oxygen are generated. HDCA, the result of adding hydrogen to ADCA, is conventionally used as a foaming agent, or as a foaming aid. HDCA's low toxicity makes it easy to handle, and less dangerous than sodium azide. Furthermore, a number of commercially available products can be used as HDCA. The particular particle shape and size of the product used as HDCA is important to achieve the required combustion characteristics of the gas generator. Optimum combustion characteristics can be achieved with HDCA products having a particle size of 300 μm or less.

Satisfactory oxidizing performance is achieved using oxohalogeno acid salts as an oxoacid salt. Any generally known halogeno acid salt compound can be used, for example, halogeno acid salts or perhalogeno acid salts. These salts are particularly preferred because they generate large amounts of oxygen gas per unit weight, have high heat stability and are widely available. In particular, alkali metal salts of oxohalogeno-acids are preferred, because they form salts having low toxicity as combustion residue. Such residue could be, for example, potassium chloride (KCl), sodium chloride (NaCl), etc. Alkali metal salts of halogeno acids include, for example, sodium chlorate ($NaClO_3$), potassium chlorate ($KClO_3$), sodium bromate ($NaBrO_3$) and potassium bromate ($KBrO_3$). Alkali metal salts of perhalogeno acids include, for example, sodium perchlorate ($NaClO_4$), potassium perchlorate ($KClO_4$), sodium perbromate ($NaBrO_4$) and potassium perbromate ($KBrO_4$).

For an oxidizing agent, a single compound or a mixture of two or more compounds selected from oxohalogeno acid salts can be used. Optimum combustion characteristics are obtained when the particle shape and size of oxohalogeno acid salt compound is 300 μm or less.

The ratio of HDCA to oxohalogeno acid salt in the gas generator according to the present invention may be varied as long as adequate ignition and burning rate characteristics are maintained. While it is preferred to increase the amount of HDCA as much as possible in order to increase the amount of gas generated, it is essential that the particular amount of HDCA selected does not produce any substantial amount of carbon monoxide formed during combustion.

In other words, the amount of HDCA used should produce concentrations of carbon monoxide in the generated gas of 5000 ppm or less. The maximum amount of HDCA which can be used to satisfy this condition is smaller than the theoretical, or stoichiometrical amount necessary to fully oxidize HDCA with oxohalogeno acid salt. However the amount of HDCA may be varied depending on the kind of oxidizing agent employed. The lower limit of HDCA content in the gas generator is determined based on the consideration that with inadequate the amounts of HDCA, molding of the gas generator becomes increasingly difficult.

Based on the above considerations, the content of HDCA should generally be 10 to 45% by weight, and the content of oxohalogeno acid salt should be in the range of 90 to 55% by weight. More preferably, the content of HDCA should be 25 to 45% by weight, and the content of oxohalogeno acid salt should be 75 to 55% by weight. When potassium perchlorate is used, for example, as the oxidizing agent, the amount of HDCA in the gas generator should be 40% or less by weight, relative to the potassium perchlorate, which should be 60% or more by weight. In addition, in order for the HDCA to act as an effective binder, the content of HDCA in the gas generator should be preferably 10% or more by weight.

As stated above, HDCA and oxohalogeno acid salts are the principal compounds in the gas generator. Were these two compounds not the principal components, the gas generator could fail to generate a sufficient volume of gas. An inorganic or organic binder can be added to the gas generator composition so long as the performance of the gas generator is not impaired. If the binder component is combustible, the amount of the oxidizing agent must be increased so as to fully oxidize the binder. A combustion controller such as a metal powder and carbon black can, as necessary, be incorporated to the gas generator composition.

To obtain the desired combustion characteristics, the gas generator of the present invention can be molded by conventional methods into any suitable form, such as a granule, pellet, rod or disc.

Since HDCA generates a small amount of heat compared with ADCA one advantage of the present invention is that the combustion temperature of the gas generator can be kept at a low level.

In addition, since the content of HDCA is smaller than the stoichiometrical amount with respect to the oxohalogeno acid salt, toxic carbon monoxide is prevented from being formed. Moreover, that portion of the oxohalogeno acid salt not used for the combustion of HDCA is burned to generate oxygen gas. This increases the amount of gas generated by the gas generator. A further advantage of using HDCA is that HDCA particles easily bind particles to each other when the gas generator is molded.

Because the gas generator according to the present invention contains no sodium azide, it is easily handled and minimizes formation of corrosive residues such as sodium and sodium compounds. This gas generator, when ignited and burned under normal conditions, generates approximately 0.4 to 0.55 lit/g of a gas containing water, carbon dioxide, oxygen and nitrogen.

A gas generator will now be described containing HDCA as a reducing agent, oxoacid salt as an oxidizing agent, and a flame coolant to cool the generated gas.

In this case, HDCA content of the gas generator is preferably but need not be limited to 10 to 42% by weight. More preferably it should be 15 to 40% by weight. If the content of HDCA is less than the specified range, the amount of the gas generated tends to be smaller and the binding of the gas generator material is degraded. If the content of HDCA is more than the specified range, harmful carbon monoxide can be formed.

The oxoacid salt used as an oxidizing agent may be an oxohalogeno acid salt, a nitrate or an oxo metal acid salt. In addition to the above-described alkali metal salts of oxohalogeno acids, the oxohalogeno acid salt may include potassium chlorate, potassium perchlorate, sodium chlorate, sodium perchlorate, potassium bromate, potassium perbromate, sodium bromate and sodium perbromate; silver perchlorate ($AgClO_4$), silver chlorate ($AgClO_3$), barium perchlorate [$Ba(ClO_4)_2$], barium chlorate [$Ba(ClO_3)_2$], calcium perchlorate [$Ca(ClO_4)_2$], cobalt perchlorate [$Co(ClO_4)_2$], lithium perchlorate ($LiClO_4$), magnesium perchlorate [$Mg(ClO_4)_2$] and tin perchlorate [$Sn(ClO_4)_2$].

The nitrate includes potassium nitrate ($KNO_3$), sodium nitrate ($NaNO_3$), strontium nitrate [$Sr(NO_3)_2$], barium nitrate [$Ba(NO_3)_2$], calcium nitrate [$Ca(NO_3)_2$] and lead nitrate [$Pb(NO_3)_2$]. The oxo metal acid salt includes potassium permanganate ($KMnO_4$), sodium permanganate ($NaMnO_4$), potassium dichromate ($K_2Cr_2O_7$), sodium dichromate ($Na_2Cr_2O_7$) and ammonium dichromate [$(NH_4)_2Cr_2O_7$]. These oxoacid salts are preferred, because they are stable at room temperature and are readily and commercially available.

Of the oxoacid salts, the preferred alkali metal salts of oxohalogeno-acid include $NaClO_4$, $NaClO_3$, $NaBrO_4$, $NaBrO_2$, $KClO_4$, $KClO_3$, $KBrO_4$ and $KBrO_3$. These salts generate large amounts of oxygen ($O_2$) per weight, have high heat stability and are readily available. Moreover, after combustion, the residue from these salts such as potassium chloride (KCl) and sodium chloride (NaCl), are compounds which are relatively low in toxicity.

In the gas generator according to the present invention, at least one compound selected from these oxoacid salts is used as the oxidizing agent. This compound should have an optimum shape and particle size to achieve the required combustion characteristics.

Optimum combustion characteristics are obtained when the particle size of the oxidizing agent is 300 μm or less. The content of the oxidizing agent in the gas generator is at least 55 to 87% by weight, and preferably 60 to 85% by weight. If the percentage of the oxidizing agent is less than 55% by weight, toxic carbon monoxide is formed. On the other hand, the percentage of the oxidizing agent is more than 87%, the amount of gas generated tends to be small.

The flame coolant, a compound which causes an endothermic decomposition reaction, is selected from the following group hydrates of metal sulfate: hydrates of metal nitrates, metal carbonates, hydrates of metal carbonates, metal hydroxide and hydrates of metal hydroxide, in which the metal moieties are selected from the III, IV, V and VI Period metals of the Periodic Table. Of these hydrates, the preferred compounds are hydrates of metal sulfates, hydrates of metal nitrates, metal carbonates, hydrates of metal carbonates, metal hydroxides and hydrates of metal hydroxide, in which the metal moieties are selected from the III period metals of the Periodic Table including aluminum (Al), magnesium (Mg) and sodium (Na); the IV Period metals of the Periodic Table including calcium (Ca), copper (Cu), iron (Fe), potassium (K), manganese (Mn), nickel (Ni) and zinc (Zn); the V Period metals of the Periodic Table including tin (Sn) and strontium (Sr); and group VI metals of the Periodic Table including barium (Ba). Further, the Al, Cu, Fe, Mn, Mg, Ni, Sn and Zn based compounds are preferred, because they form stable decomposition products. The hydroxides and hydrates formed with these elements exhibit a higher endothermic reaction than compounds formed with other elements, and for this reason are preferred.

For the gas generator to have optimum combustion characteristics, the particular flame coolant chosen should have a particular shape and particle size. The content of the flame coolant in the gas generator should be at least 3 to 35% by weight, and preferably 5 to 30% by weight. If the content of the flame coolant is less than 3% by weight, the cooling effect cannot be obtained. On the other hand, if the coolant is more than 35% by weight, the combustion temperature decreases to an extent that composition will not occur as it should.

The ratio of HDCA to the oxidizing agent in the gas generator, according to the present invention, are set as desired so long as appropriate ignitability and combustion rate are obtained.

In this context, the content ratio of HDCA to the oxidizing agent is at least in the range of from 10:90 to 43:57, and preferably in the range of from 15:85 to 40:60. If this ratio is not within the above ranges, i.e. if the content of HDCA is less than 10:90, it will be difficult to carry out molding of the gas generator. If the content of HDCA is more than 43:57, the resulting composition forms harmful carbon monoxide and is not suitable for the gas generator.

One advantage of adding a flame coolant to the gas generator composition is that it lowers the combustion temperature of the gas generator. While a cooling agent or cooling mechanism is incorporated into the gas generator container so as to prevent the air bag from burning, the amount of the cooling agent or the size of the cooling mechanism can be minimized by lowering the combustion temperature of the gas generator. This allows the gas generator to be made smaller and more compact.

For gas generators formed having only HDCA and an oxidizing agent only, optimum combustion temperatures can be selected by changing the content ratio of these two components. The combustion temperature can be lowered by using a flame coolant in addition to these two components. Accordingly, the amount of the HDCA material may be increased, to yield an increased amount of generated gas.

It should be noted in order to minimize the amount of cooling agent needed as a cooling mechanism or to minimize the size of the cooling mechanism itself, the range of the gas generator's combustion temperature should be about 1300° to 1500° C. Accordingly, the amount of flame coolant used should allow the combustion temperature to fall within the specified range. The flame coolant is preferably 3 to 35% by weight of the HDCA, the oxidizing agent and the flame coolant. If the content of the flame coolant is less than 3% by weight, sufficient cooling may not occur, causing an elevation in the combustion temperature. If the flame coolant is more than 35% by weight, the combustion temperature will be lowered to a point that retards the combustion rate, making it difficult for the gas generator to burn out within an appropriate period of time and generate a necessary amount of gas.

Based on the reasons as stated above, HDCA, the oxidizing agent and the flame coolant are preferably added in the ranges of 10 to 42% by weight, 55 to 87% by weight and 3 to 35% by weight, respectively. If these three components are not mixed within the specified ranges, the combustion temperatures may occur higher or lower than the optimum range, a minimal amount of the gas will be generated, carbon monoxide will form, and the resulting composition will not burn properly.

The total amount of HDCA, the oxidizing agent and the flame coolant in the gas generator composition should be such that they constitute the major components of the gas generator. Were these three compounds not the major components of the gas generator, the amount of gas generated would decrease.

A component serving as a binder to improve moldability may be added, to the gas generator according to the present invention, so long as performance of the gas generator is not impaired. As the binder, an inorganic compound such as sodium silicate and clay or an organic compound such as cellulose and polyester resin may be used. The content of the binder in the gas generator should be no more than 10% by weight or less, and preferably 5% by weight or less. If the binder component is combustible, more oxidizing agent must be used in order to fully oxidize the binder.

A combustion controller may be incorporated into the gas generator to adjust the combustion rate. As the combustion controller, a metal compound such as copper oxide (CuO), and zinc oxide (ZnO); metal powder such as aluminum (Al), magnesium (Mg), and boron (B); and carbon compound such as carbon black may be used. The content of the combustion controller should be no more than 10% by weight, and preferably 5% by weight or less.

Should the contents of additives including the binder and the combustion controller exceed 10% by weight, the amount of gas generated and the mechanical strength of the gas generator tend to decrease.

The gas generator according to the present invention can be obtained by metering and mixing predetermined amounts of HDCA, an oxidizing agent and a flame coolant, a binder component and a combustion controller to produce a single product. Component mixing may be carried out by conventional methods, for example, using a blender or a wet blender. The resulting mixture powder or granule is molded into a shape suited for obtaining the desired combustion characteristics. The material thus obtained is molded by an ordinary method such as press molding into a shape of pellet, rod, disc, etc.

In both types of gas generators envisioned by the present invention, i.e., in the type containing, HDCA, an oxidizing agent and a flame coolant, as in the type containing HDCA and an oxidizing agent, the combustion temperature can be held relatively low. Accordingly, the cooling agent and the like to be incorporated into the gas generator container can be reduced. Further, since the amount of vapor-containing gas increases, the amount of the gas generator needed for the gas generator container can be reduced. This allows for a more compact sized gas generator container.

HDCA exhibits good binding characteristics when molded by pressing and the like. In addition, when the gas generator is burned, it generates a large amount of harmless gas consisting of water, carbon dioxide, oxygen and nitrogen. These by products are produced in an amount of about 0.4 to 0.55 lit/g under normal operating conditions. Importantly, the combustion of the gas generator according to the present invention forms virtually no toxic carbon monoxide.

The flame coolant used in the present invention maintains the combustion temperature at low levels, due to its endothermic decomposition reaction. This allows for increased amounts of HDCA fuel to be used in the gas generator, and in turn, allows for an increased volume of gas generated by the gas generator.

Since the gas generator according to the present invention contains no toxic sodium azide, it can be handled easily, without fear of forming of corrosive residues such as sodium and sodium compounds. Moreover, the gas generator of the present invention has an initial decomposition temperature higher than conventional gas generators. This feature of HDCA imparts excellent heat stability, low impact sensitivity, and in turn, further eases the handling requirements of the gas generator.

Application of a combustion controller to a mixture of a reducing agent and an oxidizing agent increases the reaction rate of the reducing agent and the oxidizing agent. This, in turn, increases the combustion rate of the gas generator. The combustion controller is selected from combustible carbon black and metal powder. The combustion controller may also be a compound with catalytic action and selected from the group consisting of oxides, chlorides, and sulfates of transition metal, in which the metal moiety is selected from the IV, V, and VI Period metal of the Periodic Table.

Boron, aluminum, and zirconium are preferred as the metal powder because of they increase combustion reaction rate and combustibility, and because they are readily and commercially available. The temperature of these metal powders becomes high during combustion. Therefore, heat is efficiently transferred to the uncombusted gas generator. This increases the combustion rate and stabilizes combustion.

Due to the ability to increase the combustion reaction rate, the ease in handling, and the availability, metal moieties included in Period IV of the Periodic Table are preferred as the transition metal compound. Among the compound of metal moieties, titanium oxide ($TiO_2$), copper oxide (CuO), zinc oxide (ZnO), chromium oxide ($Cr_2O_3$), manganese dioxide ($MnO_2$), iron oxide ($Fe_2O_3$), cobalt oxide ($Co_2O_3$), nickel oxide (NiO), vanadium pentoxoide ($V_2O_5$), iron chloride ($FeCl_3$), manganese sulfate ($MnSo_4$), and copper chromite ($2CuO.Cr_2O_3$) are especially preferred.

Furthermore, chromium oxide ($Cr_2O_3$), iron oxide ($Fe_2O_3$), cobalt oxide ($Co_2O_3$), nickel oxide (NiO), manganese sulfate ($MnSO_4$), and copper chromite ($2CuO.Cr_2O_3$) are preferable since they increase the combustion reaction rate, greatly enhance stabilization of combustion, and enable facilitated collection of the residue after combustion.

One or more types of the compounds described above are selected to be used in the combustion controller. In other words, the combustion controller is used by combining one or more types of combustible combustion controllers, by combining one or more types of catalytic combustion controllers, or by combining a combustible combustion controller with a catalytic combustible controller. When a combustible combustion controller and a catalytic combustion controller are combined, the ignitability of the gas generator is improved and the combustion rate is enhanced.

A combustion controller having the required shape and dimension for production of the gas generator and having the required combustion characteristic is appropriately selected. In this case, it is desirable that the particle diameter is 300 μm or less for sufficient combustion.

The higher the content of the combustion controller in the gas generator is, the higher the combustion rate becomes. However, this results in the ignition sensitivity becoming sharp and causes problems in handling. Therefore, this is taken into consideration when determining the upper limit of the content of the combustion controller. From this point of view, it is preferable that the content of the combustion controller is 10% by weight or lower. It is further preferable that the content is 5% by weight or lower.

A gas generator containing HDCA, which serves as a reducing agent, oxoacid salt, which serves as an oxidizing agent, a combustion controller, and a flame coolant will now be described.

HDCA, oxoacid salt, and combustion controller are comprised of the components used for the gas generator described above.

In this gas generator, the flame coolant is used to further lower the combustion temperature of the gas generator. The flame coolant is comprised of the components described above. The content ratio of the oxidizing agent and HDCA is also described above. It is preferable for the flame coolant to have a particle size of 300 μm or less for satisfactory combustion.

In the gas generator containing HDCA, the oxidizing agent, the combustion controller, and the flame coolant, it is preferable for the content of the flame coolant to be in the range of 3 to 35% by weight. If the content of the flame coolant is less than 3% by weight, cooling becomes insufficient. This raises the combustion temperature. If the content is more than 35%, the combustion temperature decreases to an extent that the combustion rate is lowered. This leads to an insufficient amount of generated gas since complete combustion will not take place within the required period of time.

For these reasons, it is preferred that the content of HDCA, the oxidizing agent, the combustion controller and the flame coolant are in the ranges of 10 to 42% by weight, 55 to 87% by weight, 0.1 to 5% by weight, and 3 to 35% by weight, respectively. If these components are not mixed within the specified ranges, certain disadvantages will occur. Such disadvantages include the combustion temperature becoming higher or lower than its appropriate range, the amount of generated gas becoming small, formation of carbon monoxide, and the resulting composition not burning properly.

The total amount of HDCA, the oxidizing agent, the combustion controller, and the flame coolant contained in the gas generator should be such that they constitute the major components of the gas generator. If these are not the major components of the gas generator, the amount of gas generated during combustion decreases. As a result, performance of the gas generator is degraded.

The gas generator is obtained by metering and mixing predetermined amounts of HDCA, the oxidizing agent, and the combustion controller, or by metering and mixing predetermined amounts of HDCA, the oxidizing agent, the combustion controller, the flame coolant, and if required, a binder.

The gas generator contains HDCA, oxoacid salt, and the combustion controller or in another case HDCA, oxoacid salt, the combustion controller, and the flame coolant. Since the heat of formation of HDCA is smaller than cellulose acetate or ADCA used in the conventional gas generator, the gas generator of the present invention is maintained at a low temperature during combustion. Furthermore, when the flame coolant is contained in the gas generator, endothermic reaction caused by decomposition of the flame coolant leads to the gas generator being maintained at a low temperature during combustion. Accordingly, it is possible to increase the application amount of HDCA, which serves as a fuel, and increase the amount of gas generated by the combustion of the gas generator.

If the content of HDCA becomes smaller than the stoichiometry amount of oxoacid salt, formation of toxic carbon monoxide is virtually prevented. In addition, surplus oxoacid salt which was not used during the combustion of HDCA is decomposed during combustion and produces oxygen gas. As a result, a large amount of gas containing water, carbon dioxide, oxygen, and nitrogen is formed. For example, under a standard state, approximately 0.4 to 0.55 lit/g of gas is formed. Furthermore, since the decrease in combustion rate, caused by the decrease in combustion temperature, is compensated by the combustion controller, it is possible to complete combustion within the predetermined period of time with the thickness of the gas generator maintained at a proper dimension.

The handling of the gas generator is simple and formation of sodium and sodium compounds as a corrosive substance is prevented since sodium azide is not contained in the gas generator. Additionally, the initial decomposition temperature of the gas generator is higher than the conventional gas generator. This enhances heat stability and lowers impact sensitivity. Hence, the handling of the gas generator is simplified.

The present invention will now be described more specifically by way of the following Examples and Comparative Examples.

EXAMPLE 1

In example 1, a raw material was provided having a composition including 300 g of an HDCA with an average particle size of 9.6 μm and 700 g of a potassium perchlorate with an average particle size of 17 μm. 60 g of water and 240 g of acetone was added to the composition, and the resulting mixture was blended for about 20 minutes in a "SHINAGAWA" blender (an industrial strength blender manufactured by Kabushiki-Kaisha San-el Seisakusho). The wet agent from the blender was strained through a 32-mesh silk netting and dried to obtain a gas generator as a granule having a grain size of about 0.5 mm, no substantial amounts of water or acetone were contained in the dried granules.

EXAMPLES 2 AND 3

Comparative Examples 1 to 4

Gas generators were prepared according to the formulations shown in Table 1 in the same manner as described in Example 1 to yield granules.

Comparative Example 5

In example 5, a raw material was provided having the following components: 15% by weight of a cellulose acetate having an acetylation degree of 53% (hereinafter referred to as CA), 6% by weight of triacetin (hereinafter referred to as TA) as a plasticizer and 79% by weight of a potassium perchlorate having an average particle size of 17 μm (hereinafter referred to as KP). A mixture of acetone and methyl alcohol solvent was added to the composition, and the resulting mixture was blended to form a chemical knead.

The knead was then loaded on an extruder with a 4 mm-diameter die, fed under pressure to the die and extruded into rods. The rods were next cut into 2 mm long pieces and dried to form a gas generator pellet.

Initial decomposition temperature was measured for the granular or pelletized gas generator obtained in Examples 1 to 3 and in Comparative Examples 1 to 5 as described above using a differential scanning calorimeter. Further, impact ignition sensitivity was measured by a BAM friction test and a drop hammer sensitivity test in accordance with standard methods for testing the performance of explosives (JIS-K-4810). The results are summarized in Table 1. In Table 1, potassium perchlorate and potassium chlorate used in Examples 1 to 3 and Comparative Examples 1 to 4 are expressed by $KClO_4$ and $KClO_3$, respectively.

TABLE 1

| Example or Comp. Example | Composition (% by weight) | Initial decomposition temperature (°C.) | Friction sensitivity (1/6 times ignition load) (kgf) | Drop hammer sensitivity (1/6 times igniting drop hammer height) (cm) |
|---|---|---|---|---|
| Example 1 | HDCA - $KClO_4$ (30/70) | 265 | ≧36 | 40–50 |
| Example 2 | HDCA - $KClO_4$ (40/60) | 263 | ≧36 | ≧50 |
| Example 3 | HDCA - $KClO_3$ (35/65) | 265 | ≧36 | 30–40 |

TABLE 1-continued

| Example or Comp. Example | Composition (% by weight) | Initial decomposition temperature (°C.) | Friction sensitivity (1/6 times ignition load) (kgf) | Drop hammer sensitivity (1/6 times igniting drop hammer height) (cm) |
|---|---|---|---|---|
| Comp. Example 1 | HDCA - $KClO_4$ (47/53) | 263 | ≧36 | ≧50 |
| Comp. Example 2 | ADCA - $KClO_4$ (30/70) | 212 | ≧36 | 20–30 |
| Comp. Example 3 | ADCA - $KClO_4$ (45/55) | 212 | ≧36 | 30–40 |
| Comp. Example 4 | ADCA - $KClO_4$ (50/50) | 210 | ≧36 | 30–40 |
| Comp. Example 5 | CA-TA-KP (15/6/79) | 494 | 16–36 | 20–30 |

As shown in Table 1, in these tests, the gas generators containing HDCA have an initial on temperature higher than the conventional gas generators containing ADCA and have excellent heat stability. Further, these gas generators containing HDCA have low impact sensitivity compared with the gas generators containing ADCA or the conventional gas generator as shown in Comparative Example 5. This furthers the ease with which the gas generator may be handled.

The granular gas generators obtained in Examples 1 to 3 and Comparative examples 1 to 5 were subjected to press molding using a rotary tablet machine to yield pellet shaped particles. The pellets were then loaded in each gas generator container, as shown in FIG. 1, such that the amount of gas to be generated under the standard conditions was measured to be about 30 lit. In FIG. 1, a cylindrical gas generator container 1 has an igniter chamber 2 located at the center of the container 1, a combustion chamber 3 formed concentrically around the igniter chamber 2 and a cooling chamber 4 also formed concentrically around the combustion chamber 3.

A squib 5 and an igniter 6 are disposed in the igniter chamber 2. The igniter 6 is ignited when the squib 5 is charged. A pelletized gas generator 7 is loaded in the combustion chamber 3 and burned by the flame, created by the igniter 6, to generate a gas containing nitrogen etc. Cooling filters 8,9 are disposed in the combustion chamber 3 and the cooling chamber 4 respectively. These cooling filters 8,9 serve to cool the generated gas as well as to filter and collect the solid combustion residues.

A wall 12 interposed between the igniter chamber 2 and the combustion chamber 3, and a wall 13 interposed between the combustion chamber 3 and the cooling chamber 4 contain a plurality of openings 10,11. These openings 10,11 allow communication of the flame produced from the igniter 6 to the chamber 3 and the gas generated from the gas generator 7 to the cooling chamber 4. The circumferential wall 15 of the cooling chamber 4 contains gas exhaust ports 14. The gas cooled in the cooling chamber 4 is exhausted through these ports 14 into an air bag 16.

In case of a car crash, the igniter 6 is ignited by the squib 5 based on a signal. The flame from the igniter 6 propagates through the openings 10 into the combustion chamber 3 where and the gas generator 7 burns to generate gas. The generated gas passes through the cooling filter 8 and openings 11 and is exhausted from the ports 14.

In this test, the gas generator container 1 was attached to a 60 liter tank. The in-tank gas temperature after actuation of the gas generator container was measured using an alumel-chromel thermocouple having a strand diameter of 50 μm. The results are summarized in Table 2. It should be noted that the amount of gas generated shown in Table 2 is indicated in terms of the total volume of carbon dioxide, water, oxygen and nitrogen, measured under the standard conditions, with 1 g of the gas generator being burned.

TABLE 2

| Example or Comp. Example | Composition (% by weight) | Amount of gas formed (lit/g) | In-tank gas temperature (°C.) | CO level in gas formed (ppm) |
|---|---|---|---|---|
| Example 1 | HDCA - $KClO_4$ 30/70) | 0.438 | 216 | 500 |
| Example 2 | HDCA - $KClO_4$ (40/60) | 0.509 | 277 | 800 |
| Example 3 | HDCA - $KClO_3$ 35/65) | 0.453 | 324 | 200 |
| Comp. Example 1 | HDCA - $KClO_4$ (47/53) | 0.543 | 236 | 49000 |
| Comp. Example 2 | ADCA - $KClO_4$ (30/70) | 0.418 | 274 | 1000 |
| Comp. Example 3 | ADCA - $KClO_4$ (45/55) | 0.520 | 403 | 2700 |
| Comp. Example 4 | ADCA - $KClO_4$ (50/50) | 0.542 | 351 | 61000 |
| Comp. Example 5 | CA-TA-KP (15/6/79) | 0.385 | 407 | 600 |

The results of Comparative Example 1 or 4 show that, when the amount of HDCA or ADCA added to the composition exceeds the stoichiometrical amount, an insufficient amount of oxygen is produced. A large amount of carbon monoxide however is formed, making the composition not well suited as an air bag inflating gas generator. Meanwhile, the results of Examples 1 to 3 show that the preferred range of the HDCA content and that of the oxohalogeno acid salt content are 25 to 45% by weight and 75 to 55% by weight, respectively.

Further, in a comparison between Example 1 and Comparative Example 2, the gas generator containing HDCA generated a larger volume of gas and produced a lower in-tank gas temperature than in comparative example 2. In addition, the gas generator containing HDCA generated a notably large amount of gas and produced a lower in-tank gas temperature compared with the gas generator shown in Comparative Example 5.

Next, the gas generator of the present invention will more specifically describe the remaining Examples and Comparative Examples.

(Performance test of gas generator)

Initial decomposition temperatures were determined for each gas generator using a differential scanning calorimeter so as to evaluate heat stability. Further, impact ignition sensitivity is measured by BAM friction test and drop hammer sensitivity test in accordance with the standard methods for testing explosive performance of explosives (JIS-K-4810). Handling performance was evaluated for each gas generator using the above procedures.

(Combustion test)

Each granular gas generator is press molded in a rotary tablet machine to yield a pelletized gas generator. The pellet was then loaded in the gas generator 1 shown in FIG. 1 and subjected to a combustion test in the following manner so as to evaluate its performance.

First, the gas generator was loaded in the gas generator container 1 shown in FIG. 1 in an amount to generate about 30 lit of gas under the standard combustion conditions.

Next, the gas generator container 1 was attached to a 60 liter tank, and the in-tank gas temperature upon actuation of the gas generator container 1 was measured using an alumel-chromel thermocouple having a strand diameter of 50 μm. The concentration of carbon monoxide contained in the gas in the tank was then measured. In this test the amount of gas generated was taken as the total volume of carbon dioxide, water, oxygen and nitrogen, measured under the standard conditions, generated when 1 g of the gas generator was burned.

EXAMPLE 4

In this example, the following compounds were mixed in a "SHINAGAWA" blender: 250 g of an HDCA having an average particle size of 9.6 μm, 600 g of a potassium perchlorate having an average particle size of 17 μm, 150 g of hydrate of aluminum nitrate (reagent), 100 g of water and 200 g of acetone. The resulting paste like mixture was strained through a 32-mesh silk netting and dried to obtain a granular gas generator having an average grain size of about 0.5 mm. This gas generator was then used to carry out the performance test and combustion test in the manner described above. The evaluation results are summarized in Tables 3 and 5.

EXAMPLE 5 TO 17

Comparative Examples 6 and 7

Gas generators were prepared according to the formulations shown in Tables 3 and 4 in the same manner as in Example 1 to yield granules and pellets, respectively. The performance test and combustion test were then carried out in the same manner as in Example 1, with results as summarized in Tables 3 to 6.

Comparative Example 8

In comparative example 8, 150 g of CA, 60 g of TA, 790 g of KP having an average particle size of 17 μm, to yield a chemical knead 480 g of acetone and 120 g of methyl alcohol were mixed in a "WERENER" kneader (an industrial kneader manufactured by Satake Kagaku Kabushiki-Kaisha) were homogeneously mixed.

The knead was then loaded on a vertical extruder having a 4 mm-diameter die. The knead was fed under pressure to the die and extruded to form rods. The rods were cut into 2 mm long pieces and dried to form gas generator pellets. The performance test and combustion test were then carried out in the same manner as in Example 1. The evaluation results of this comparative example are summarized in Tables 4 and 6.

TABLE 3

| Example or Comp. Example | Composition (% by weight) | | Initial decomposition temperature (°C.) | Friction sensitivity (1/6 times ignition load) (kgf) | Drop hammer sensitivity (1/6 times igniting drop hammer height) (cm) |
|---|---|---|---|---|---|
| Example 4 | HDCA | (25) | 241 | ≧36 | 30 |
| | $KClO_4$ | (60) | | | |
| | $Al(NO_3)_3 .9H_2O$ | (15) | | | |
| Example 5 | HDCA | (15) | 265 | ≧36 | 40 |
| | $KClO_4$ | (82) | | | |
| | $Mg(OH)_2$ | (3) | | | |
| Example 6 | HDCA | (37) | 265 | ≧36 | 30 |
| | $KClO_4$ | (60) | | | |
| | $Mg(OH)_3$ | (3) | | | |
| Example 7 | HDCA | (25) | 265 | ≧36 | 30 |
| | $KClO_3$ | (60) | | | |
| | $Mg(OH)_2$ | (15) | | | |
| Example 8 | HDCA | (25) | 266 | ≧36 | 40 |
| | $KClO_4$ | (70) | | | |
| | $NiCO_3 .2Ni(OH)_2 .4H_2O$ | (5) | | | |
| Example 9 | HDCA | (25) | 265 | ≧36 | 30–40 |
| | $KClO_4$ | (70) | | | |
| | $Sn(OH)_2$ | (5) | | | |
| Example 10 | HDCA | (25) | 256 | ≧36 | 60 |
| | $KClO_4$ | (60) | | | |
| | $FeSO_4 .7H_2O$ | (15) | | | |
| Example 11 | HDCA | (25) | 263 | ≧36 | 30 |
| | $KClO_4$ | (60) | | | |
| | $4MgCO_3 .Mg(OH)_2 \cdot 5H_2O$ | (15) | | | |

TABLE 4

| Example or Comp. Example | Composition (% by weight) | | Initial decomposition temperature (°C.) | Friction sensitivity (1/6 times ignition load) (kgf) | Drop hammer sensitivity (1/6 times igniting drop hammer height) (cm) |
|---|---|---|---|---|---|
| Example 12 | HDCA | (22) | 264 | ≧36 | 30 |
| | $KClO_4$ | (75) | | | |
| | $Ba(OH)_2 .8H_2O$ | (3) | | | |
| Example 13 | HDCA | (25) | 265 | ≧36 | 30 |
| | $KClO_4$ | (60) | | | |
| | $Ba(OH)_2 .8H_2O$ | (15) | | | |
| Example 14 | HDCA | (27) | 265 | ≧36 | 40 |
| | $KClO_4$ | (43) | | | |
| | $Ba(OH)_2 .8H_2O$ | (30) | | | |
| Example 15 | HDCA | (25) | 264 | ≧36 | 40–50 |
| | $NaNO_3$ | (65) | | | |
| | $Mg(OH)_2$ | (15) | | | |
| Example 16 | HDCA | (30) | 265 | ≧36 | 40 |
| | $Sr(NO_3)_2$ | (60) | | | |
| | $Al(OH)_3$ | (10) | | | |
| Example 17 | HDCA | (35) | 244 | ≧36 | 30 |
| | $KMnO_4$ | (60) | | | |
| | $Zn(OH)_2$ | (5) | | | |
| Comp. Example 6 | HDCA | (20) | 265 | ≧36 | 40–50 |
| | $KClO_4$ | (80) | | | |
| Comp. Example 7 | ADCA | (20) | 212 | ≧36 | 30–40 |
| | $KClO_4$ | (80) | | | |
| Comp. Example 8 | Cellulose acetate | (15) | 494 | 16–36 | 20–30 |
| | Triacetin | (6) | | | |
| | $KClO_4$ | (79) | | | |

TABLE 5

| Example or Comp. Example | Composition (% by weight) | | Amount of gas formed (lit/g) | In-tank gas temperature (°C.) | CO level in gas formed (ppm) |
|---|---|---|---|---|---|
| Example 4 | HDCA | (25) | 0.434 | 165 | 300 |
| | $KClO_4$ | (60) | | | |
| | $Al(NO_3)_3 .9H_2O$ | (15) | | | |
| Example 5 | HDCA | (15) | 0.415 | 147 | 300 |
| | $KClO_4$ | (82) | | | |
| | $Mg(OH)_2$ | (3) | | | |
| Example 6 | HDCA | (37) | 0.518 | 193 | 400 |
| | $KClO_4$ | (60) | | | |
| | $Mg(OH)_2$ | (3) | | | |
| Example 7 | HDCA | (25) | 0.436 | 186 | 500 |
| | $KClO_3$ | (60) | | | |
| | $Mg(OH)_2$ | (15) | | | |
| Example 8 | HDCA | (25) | 0.457 | 175 | 300 |
| | $KClO_4$ | (70) | | | |
| | $NiCO_3 .2Ni(OH)_2 .4H_2O$ | (5) | | | |
| Example 9 | HDCA | (25) | 0.446 | 172 | 350 |
| | $KClO_4$ | (70) | | | |
| | $Sn(OH)_2$ | (5) | | | |
| Example 10 | HDCA | (25) | 0.456 | 160 | 400 |
| | $KClO_4$ | (60) | | | |
| | $FeSO_4 .7H_2O$ | (15) | | | |
| Example 11 | HDCA | (25) | 0.463 | 158 | 400 |
| | $KClO_4$ | (60) | | | |
| | $4MgCO_3 .Mg(OH)_2 \cdot 5H_2O$ | (15) | | | |

TABLE 6

| Example or Comp. Example | Composition (% by weight) | | Amount of gas formed (l/g) | In-tank gas temperature (°C.) | CO level in gas formed (ppm) |
|---|---|---|---|---|---|
| Example 12 | HDCA | (22) | 0.445 | 188 | 300 |
| | $KClO_4$ | (75) | | | |
| | $Ba(OH)_2 .8H_2O$ | (3) | | | |
| Example 13 | HDCA | (25) | 0.490 | 177 | 400 |
| | $KClO_4$ | (60) | | | |
| | $Ba(OH)_2 .8H_2O$ | (15) | | | |
| Example 14 | HDCA | (27) | 0.540 | 169 | 900 |
| | $KClO_4$ | (43) | | | |
| | $Ba(OH)_2 .8H_2O$ | (30) | | | |
| Example 15 | HDCA | (25) | 0.437 | 152 | 300 |
| | $NaNO_3$ | (65) | | | |
| | $Mg(OH)_2$ | (15) | | | |
| Example 16 | HDCA | (30) | 0.447 | 162 | 450 |
| | $Sr(NO_3)_2$ | (60) | | | |
| | $Al(OH)_3$ | (10) | | | |
| Example 17 | HDCA | (35) | 0.431 | 152 | 350 |
| | $KMnO_4$ | (60) | | | |
| | $Zn(OH)_2$ | (5) | | | |
| Comp. Example 6 | HDCA | (20) | 0.429 | 195 | 400 |
| | $KClO_4$ | (80) | | | |
| Comp. Example 7 | ADCA | (20) | 0.413 | 292 | 400 |
| | $KClO_4$ | (80) | | | |
| Comp. Example 8 | Cellulose acetate | (15) | 0.385 | 407 | 600 |
| | Triacetin | (6) | | | |
| | $KClO_4$ | (79) | | | |

As shown in Comparative Example 8 summarized in Table 4, the gas generator comprising CA, TA and KP exhibited excellent heat stability due to its high initial decomposition temperature, but had a high friction sensitivity, making it a generator requiring careful handling. The gas generator composition containing ADCA shown in Comparative Example 2 exhibited low friction sensitivity, but had poor heat stability due to its low initial decomposition temperature.

As shown in Tables 3 and 4, the gas generators according to the present invention shown in Examples 4 to 17 exhibited a low friction sensitivity compared with the gas generator of Comparative Example 8. Moreover, the gas generators of Examples 4 to 17 each had a high initial decomposition temperature compared with the gas generator of Comparative Example 7. Consequently, the gas generators according to the present invention exhibited superior handling characteristics and excellent heat stability.

As the results of combustion test shown in Table 6 demonstrate, the gas generator shown in Comparative Example 8 generates a small amount of gas at a high gas temperature. In the gas generator containing ADCA shown in Comparative Example 7, a large volume of gas was generated and the temperature of the gas was low compared with Comparative Example 8. However, in examples 4–17, the amount of the gas generated was still small, and the gas temperature still high. Compared with comparative example 7, the gas generator containing HDCA in comparative Example 6 generated a greater volume of gas at a lower combustion temperature.

On the other hand, as shown in Tables 3 to 6, the gas generators according to the present invention shown in Examples 4 to 17 each contain a flame coolant, so that not only was the amount of the gas generated increased, but the gas temperature lower than in the Comparative Examples. As shown in Example 12, such effects can be exhibited using a small amount of flame coolant. As shown in Examples 13 and 14, as the content of the flame coolant increased, the amount of the generated gas increases and the gas temperature drops. The present invention will be described further more specifically by way of the following Examples and Comparative Examples.

The granular igniter of the gas generator is utilized to form a square pillar shaped molding (or "strand") having the dimensions of 5 mm width×8 mm height×50 mm length by an exclusive mold and manual hydraulic press machine in order to measure the combustion rate. By coating the side surface of the strand with epoxy resin, combustion of all surfaces is prevented. Two holes having a diameter of 0.5 mm are drilled opened with appropriate distance in the longitudinal direction in between. A fuse is fitted into each hole penetrating it to measure the combustion time.

The strand is then placed on a platform. A nichrome wire is ignited at one edge of the strand pressurized at 30 atmospheric pressure to electrically measure the moment the fuse is melted when the combustion surface passes by. The combustion rate is as a combustion rate along a line is calculated by dividing the distance between the two points with the time lapse.

EXAMPLE 18

In this example, the following compounds were mixed: 200 g of HDCA having an average particle size of 9.6 μm, 770 g of KP having an average particle size of 17 μm, 30 g of boron having an average particle size of 1 μm, 100 g of water, and 200 g of acetone. The resulting paste like mixture was strained through a 32-mesh silk netting and dried to obtain a granular igniter having an average particle size of about 0.5 mm as a gas generator. This gas generator was then used to carry out the performance test and combustion test described above. The evaluation results are summarized in Tables 3 and 5.

EXAMPLES 19–23

Comparative Examples 9 and 10

A performance test and combustion test was carried out in the same manner as Example 18 with the composition shown in Table 7. The evaluation results are summarized in Tables 7 and 8.

TABLE 7

| Example or Comp. Example | Composition (% by weight) | | Initial decomposition temperature (°C.) | Friction sensitivity (1/6 times ignition load) (kgf) | Drop hammer sensitivity (1/6 times igniting drop hammer height) (cm) |
|---|---|---|---|---|---|
| Example 18 | HDCA | (25) | 265 | ≧36 | 20–30 |
| | $KClO_4$ | (70) | | | |
| | B | (5) | | | |
| Example 19 | HDCA | (25) | 265 | ≧36 | 40 |
| | $KClO_4$ | (72) | | | |
| | B | (3) | | | |
| Example 20 | HDCA | (25) | 265 | ≧36 | 40 |
| | $KClO_4$ | (74.9) | | | |
| | B | (0.1) | | | |
| Example 21 | HDCA | (25) | 265 | ≧36 | 20–30 |
| | $KClO_4$ | (68) | | | |
| | $Mg(OH)_2$ | (5) | | | |
| | B | (5) | | | |
| Example 22 | HDCA | (22) | 265 | ≧36 | 40 |
| | $KClO_4$ | (70) | | | |
| | $Mg(OH)_2$ | (5) | | | |
| | B | (3) | | | |
| Example 23 | HDCA | (22) | 266 | ≧36 | 40 |
| | $KClO_4$ | (72.9) | | | |
| | $Mg(OH)_2$ | (5) | | | |
| | B | (0.1) | | | |
| Comp. Example 9 | HDCA | (25) | 265 | ≧36 | 40–50 |
| | $KClO_4$ | (75) | | | |
| Comp. Example 10 | HDCA | (22) | 265 | ≧36 | 40 |
| | $KClO_4$ | (73) | | | |
| | $Mg(OH)_2$ | (5) | | | |

TABLE 8

| Example or Comp. Example | Composition (% by weight) | | Amount of gas formed (l/g) | In-tank gas temperature (°C.) | CO level in gas formed (ppm) | Combustion rate mm/sec |
|---|---|---|---|---|---|---|
| Example 18 | HDCA | (25) | 0.437 | 207 | 500 | 18.9 |
| | $KClO_4$ | (70) | | | | |
| | B | (5) | | | | |
| Example 19 | HDCA | (25) | 0.441 | 194 | 400 | 16.1 |
| | $KClO_4$ | (72) | | | | |
| | B | (3) | | | | |
| Example 20 | HDCA | (25) | 0.455 | 189 | 400 | 11.8 |
| | $KClO_4$ | (74.9) | | | | |
| | B | (0.1) | | | | |
| Example 21 | HDCA | (22) | 0.410 | 196 | 500 | 18.4 |
| | $KClO_4$ | (68) | | | | |
| | $Mg(OH)_2$ | (5) | | | | |
| | B | (5) | | | | |
| Example 22 | HDCA | (22) | 0.415 | 189 | 400 | 15.5 |
| | $KClO_4$ | (70) | | | | |
| | $Mg(OH)_2$ | (5) | | | | |
| | B | (3) | | | | |
| Example 23 | HDCA | (22) | 0.434 | 183 | 350 | 12.1 |
| | $KClO_4$ | (72.9) | | | | |
| | $Mg(OH)_2$ | (5) | | | | |
| | B | (0.1) | | | | |
| Comp. Example 9 | HDCA | (25) | 0.456 | 188 | 400 | 11.0 |
| | $KClO_4$ | (75) | | | | |
| Comp. Example 10 | HDCA | (22) | 0.436 | 181 | 400 | 11.2 |
| | $KClO_4$ | (73) | | | | |
| | $Mg(OH)_2$ | (5) | | | | |

As shown in Table 7, heat stabilization is maintained regardless of the initial decomposition temperature of the gas generator when boron (B) is employed as a combustion controller. The drop hammer sensitivity is low when the application amount is in the range described in Examples 18 to 23 and facilitates handling. However, as shown in Table 7, increase of the boron (B) application amount will result in high sensitivity and make caution during handling will to be necessary.

Regarding the results of the combustion performance test shown in Table 8, the combustion rates of the gas generators described in Comparative Examples 9 and 10 are slow. The thickness of the gas generator pellet must be formed thin to complete combustion in the gas generator container within a predetermined time when the gas generator combustion rate is too slow. However, this will decrease the mechanical strength of the gas generator pellet will lead to its cracking and breaking into pieces if the gas generator container is exposed to harsh environment such as strong vibrations of an automobile or great difference in temperature during a long period of time. This will cause the pressure within the combustion chamber of the gas generator to become unexpectedly high. Fast combustion rate of the gas generator is preferable.

The gas generator according to the present invention described in Examples 18 to 23 of Table 8 has a greatly improved combustion rate by applying boron (B) as a gas generator. This enables the gas generator pellet to be formed thick and increases its mechanical strength. This effect can be attained by a mere application amount of 0.1% weight. Although, increase in application amount will greatly improve the combustion rate, there is a tendency of the gas generation amount to decrease and the temperature within the tank to increase. Therefore, it is preferable to maintain the application amount of the boron (B) as a combustion agent within the range of 0.1 to 5 weight %.

EXAMPLE 24

In example 24, a raw material having a composition containing 25% by weight of HDCA with an average particle size of 9.6 μm, 70% by weight of potassium perchlorate with an average particle size of 17 μm, and 5% by weight of copper chromite was provided. An appropriate amount of acetonate of water and acetone was added to the composition and blended for about 20 minutes in the "Shinagawa" blender. The wet agent from the blender was strained through a 32-mesh silk netting and dried to obtain a gas generator as a granule having a grain size of about 0.5 mm. No substantial amounts of water or acetone were contained in the dried granules.

EXAMPLES 25 TO 39

Comparative Examples 11 to 13

Gas generators were prepared according to the compositions shown in Table 9 in the same manner as described in Example 24 to yield granules.

Initial decomposition temperature was measured for the granular gas generator obtained in Examples 25 to 39 and comparative examples 11 to 13 as described above using the differential scanning calorimeter. Further, impact ignition sensitivity was measured by the BAM friction test and the drop hammer sensitivity test in accordance with standard methods for testing the performance of explosives (JIS-K-4810). The results are summarized in Tables 9 to 11.

TABLE 9

| Example | Composition (% by weight) | Initial decomposition temperature (°C.) | Friction sensitivity (1/6 times ignition load) (kgf) | Drop hammer sensitivity (1/6 times igniting drop hammer height) (cm) |
|---|---|---|---|---|
| Example 24 | HDCA - $KClO_4$ - $2CuO.Cr_2O_3$ (25/70/5) | 259 | ≧36 | 40–50 |
| Example 25 | HDCA - $KClO_4$ - $2CuO.Cr_2O_3$ (25/72/3) | 261 | ≧36 | 40 |
| Example 26 | HDCA - $KClO_4$ - $2CuO.Cr_2O_3$ (25/74.5/0.5) | 264 | ≧36 | 40 |
| Example 27 | HDCA - $KClO_4$ - $Mg(OH)_2$ - $2CuO.Cr_2O_3$ (22/68/5/5) | 260 | ≧36 | 40–50 |
| Example 28 | HDCA - $KClO_4$ - $Mg(OH)_2$ - $2CuO.Cr_2O_3$ (22/70/5/3) | 261 | ≧36 | 50 |
| Example 29 | HDCA - $KClO_4$ - $Mg(OH)_2$ - $2CuO.Cr_2O_3$ (22/72.5/5/0.5) | 265 | ≧36 | 40 |
| Example 30 | HDCA - $KClO_4$ - CuO (25/72/3) | 264 | ≧36 | 40–50 |
| Example 31 | HDCA - $KClO_4$ - $Mg(OH)_2$ - CuO (22/70/5/3) | 265 | ≧36 | 40 |

TABLE 10

| Example | Composition (% by weight) | Initial decomposition temperature (°C.) | Friction sensitivity (1/6 times ignition load) (kgf) | Drop hammer sensitivity (1/6 times igniting drop hammer height) (cm) |
|---|---|---|---|---|
| Example 32 | HDCA - $KClO_4$ - B - $2CuO.Cr_2O_3$ (22/73/4/1) | 263 | ≧36 | 30–40 |
| Example 33 | HDCA - $KClO_4$ - $Mg(OH)_2$ - B - $2CuO.Cr_2O_3$ (22/68/5/4/1) | 263 | ≧36 | 40 |
| Example 34 | HDCA - $KClO_4$ - B - $FeCl_3$ (22/73/4/1) | 263 | ≧36 | 40 |
| Example 35 | HDCA - $KClO_4$ - $Mg(OH)_2$ - B - $FeCl_3$ (22/68/5/4/1) | 263 | ≧36 | 40–50 |
| Example 36 | HDCA - $KClO_4$ - $2CuO.Cr_2O_3$ - ZnO (22/73/4/1) | 263 | ≧36 | 40 |
| Example 37 | HDCA - $KClO_4$ - $Mg(OH)_2$ - $2CuO.Cr_2O_3$ - ZnO (22/68/5/4/1) | 263 | ≧36 | 40–50 |
| Example 38 | HDCA - $KClO_4$ - B - $MnSO_4$ (22/73/4/1) | 264 | ≧36 | 40 |
| Example 39 | HDCA - $KClO_4$ - $Mg(OH)_2$ - B - $MnSO_4$ (22/68/5/4/1) | 263 | ≧36 | 40 |

TABLE 11

| Comp. Example | Composition (% by weight) | Initial decomposition temperature (°C.) | Friction sensitivity (1/6 times ignition load) (kgf) | Drop hammer sensitivity (1/6 times igniting drop hammer height) (cm) |
|---|---|---|---|---|
| Comp. Example 11 | ADCA - $KClO_4$ - (20/80) | 212 | ≧36 | 30–40 |
| Comp. Example 12 | ADCA - $KClO_4$ - CuO (25/72/3) | 208 | ≧36 | 30–40 |
| Comp. Example 13 | ADCA - $KClO_4$ - $Mg(OH)_2$ (22/73/5) | 212 | ≧36 | 30–40 |

As apparent from the comparative example 11 shown in Table 3, although the gas generator using ADCA has low friction sensitivity, heat stability is low since the initial decomposition temperature is low. Furthermore, the initial decomposition temperatures of the gas generator containing ADCA, KP, and copper oxide (comparative example 12) and the gas generator composed of ADCA, KP, and magnesium hydroxide (comparative example 13) are low. Thus, the heat stability is low.

The gas generators obtained in examples 24 to 39, which are shown in Tables 9 and 10, have low friction sensitivity. This allows easy handling. In addition, since the initial decomposition temperature is higher than the gas generators of comparative examples 11 to 13, the heat stability is superior.

Furthermore, the granular gas generators were subjected to press molding using a rotary tablet machine to yield pellet shaped particles. The pellets were then loaded in the gas generator container 1, as shown in FIG. 1. A combustion test was then conducted to evaluate its performance.

In another test, the granular gas generators of examples 24 to 39 and comparative examples 11 to 13 were molded by a hydraulic pressing machine with exclusively made molds. The resulting square pillar shaped molded product (hereafter referred to as strand) having the dimension of 5 mm×8 mm×50 mm was used to measure combustion rate. In other words, by coating the side surfaces of the strand with an epoxy resin, combustion of all surfaces was prevented. Two holes with appropriate space between each other in the longitudinal direction was formed by a drill with a diameter of 0.5 mm. A fuse was then inserted into each hole to measure combustion time.

The strand samples were placed on a fixed platform and pressurized to 30 atmosphere. One end of the strand was then ignited by a nichrome wire. Fusion of each fuse was detected electrically when the combustion surface passed by. By dividing the distance between the two points with the time lapse, the combustion rate was calculated as a linear combustion velocity. The result is summarized in Tables 12 to 14.

TABLE 12

| Example | Composition (% by weight) | Amount of gas formed (l/g) | In-tank gas temperature (°C.) | CO level in gas formed (ppm) | Combustion rate (mm/sec) |
|---|---|---|---|---|---|
| Example 24 | HDCA - $KClO_4$ - $2CuO.Cr_2O_3$ (25/70/5) | 0.439 | 203 | 500 | 19.2 |
| Example 25 | HDCA - $KClO_4$ - $2CuO.Cr_2O_3$ (25/72/3) | 0.443 | 191 | 400 | 16.7 |
| Example 26 | HDCA - $KClO_4$ - $2CuO.Cr_2O_3$ (25/74.5/0.5) | 0.457 | 188 | 400 | 12.3 |
| Example 27 | HDCA - $KClO_4$ - $Mg(OH)_2$ - $2CuO.Cr_2O_3$ (22/68/5/5) | 0.422 | 193 | 500 | 18.9 |
| Example 28 | HDCA - $KClO_4$ - $Mg(OH)_2$ - $2CuO.Cr_2O_3$ (22/70/5/3) | 0.426 | 186 | 400 | 14.7 |
| Example 29 | HDCA - $KClO_4$ - $Mg(OH)_2$ - $2CuO.Cr_2O_3$ (22/72.5/5/0.5) | 0.436 | 181 | 350 | 12.0 |
| Example 30 | HDCA - $KClO_4$ CuO (25/72/3) | 0.436 | 187 | 400 | 13.6 |
| Example 31 | HDCA - $KClO_4$ - $Mg(OH)_2$ - CuO (22/70/5/3) | 0.424 | 184 | 400 | 13.2 |

TABLE 13

| Example | Composition (% by weight) | Amount of gas formed (l/g) | In-tank gas temperature (°C.) | CO level in gas formed (ppm) | Combustion rate (mm/sec) |
|---|---|---|---|---|---|
| Example 32 | HDCA - $KClO_4$ - B - $2CuO.Cr_2O_3$ (22/73/4/1) | 0.428 | 193 | 400 | 17.3 |
| Example 33 | HDCA - $KClO_4$ - $Mg(OH)_2$ - B - $2CuO.Cr_2O_3$ (22/68/5/4/1) | 0.421 | 188 | 400 | 16.4 |
| Example 34 | HDCA - $KClO_4$ - B - $FeCl_3$ (22/73/4/1) | 0.424 | 195 | 500 | 18.1 |
| Example 35 | HDCA - $KClO_4$ - $Mg(OH)_2$ - B - $FeCl_3$ (22/68/5/4/1) | 0.416 | 191 | 400 | 16.9 |
| Example 36 | HDCA - $KClO_4$ - $2CuO.Cr_2O_3$ - ZnO (22/73/4/1) | 0.423 | 185 | 400 | 18.1 |
| Example 37 | HDCA - $KClO_4$ - $Mg(OH)_2$ - $2CuO.Cr_2O_3$ - ZnO (22/68/5/4/1) | 0.419 | 182 | 350 | 17.4 |
| Example 38 | HDCA - $KClO_4$ - B - $MnSO_4$ (22/73/4/1) | 0.424 | 184 | 400 | 17.7 |
| Example 39 | HDCA - $KClO_4$ - $Mg(OH)_2$ - B - $MnSO_4$ (22/68/5/4/1) | 0.420 | 190 | 400 | 16.5 |

TABLE 14

| Comp. Example | Composition (% by weight) | Amount of gas formed (l/g) | In-tank gas temperature (°C.) | CO level in gas formed (ppm) | Combustion rate (mm/sec) |
|---|---|---|---|---|---|
| Comp. Example 11 | ADCA - $KClO_4$ (20/80) | 0.413 | 292 | 400 | 9.2 |
| Comp. Example 12 | ADCA - $KClO_4$ - CuO (25/72/3) | 0.432 | 241 | 400 | 13.2 |
| Comp. Example 13 | ADCA - $KClO_4$ - $Mg(OH)_2$ (22/73/5) | 0.425 | 213 | 600 | 9.7 |

The gas generators of examples 24 to 39, which are shown in Tables 12 and 13, contained combustion controllers. As a result, the combustion rate was higher than when compared to each comparative example. The gas temperature was lower and the amount of generated gas was greater in comparison with the conventional gas generator, which is shown in comparative example 11 of Table 14. This effect was also obtained on gas generators using the flame coolant. Furthermore, it was possible to use various types of combustion controllers simultaneously.

The combustion temperature of the gas generator composed of ADCA, potassium perchlorate, and copper oxide (comparative example 12) was high. The combustion temperature and carbon monoxide concentration was high and the combustion rate was low for the gas generator composed of ADCA, potassium perchlorate, and magnesium hydroxide (comparative example 13).

Although only one embodiment of the present invention has been described herein, it should be apparent to those skilled in the art that the present invention may be embodied in many other specific forms without departing from the spirit or scope of the invention. Particularly, it should be understood that the following modes are to be applied:

(1) The gas generator according to the present invention may be loaded in an air bag apparatus such as a life preserver, a pneumatic boat and an escape chute;

(2) The gas generator may be formed into a pellet having a C-shaped cross-section, a tube with a single bore or multiple bores, etc.; and (3) The gas generator container may be formed to have a slender cylindrical form, and the gas generator may be loaded in the combustion chamber thereof.

Therefore, the present examples and embodiments are to be considered as illustrative and not restrictive, and the invention is not to be limited to the details given herein, but may be modified within the scope of the appended claims.

What is claimed is:

1. A gas generator composition comprising:

hydrazodicarbonamide serving as a reducing agent for generating a gas when oxidized, said hydrazodicarbonamide ranging from 10 to 45% by weight;

oxoacid salt serving as an oxdizing agent for oxidizing the reducing agent, said oxoacid salt ranging from 90 to 55% by weight;

a combustion controller with catalytic function, said controller including at least one compound selected from the group consisting of titanium oxide ($TiO_2$), copper oxide (CuO), zinc oxide (ZnO), manganese dioxide ($MnO_2$), iron chloride ($FeCl_3$) and manganese sulfate ($MnSO_4$);

said combustion controller ranging from 0.1 to 5% by weight and said combustion controller containing at least one element selected from the group consisting of boron, aluminum and zirconium.

2. A gas generator composition comprising:

hydrazodicarbonamide serving as a reducing agent for generating a gas when oxidized;

said hydrazodicarbonamide ranging from 10 to 45% by weight, oxoacid salt serving an oxidizing agent for oxidizing the reducing agent, said oxoacid salt ranging from 90 to 55% by weight, a combustible combustion controller containing at least one element selected from the group consisting of boron, aluminum and zirconium; and said combustible combustion controller ranging from 0.1 to 5% by weight.

3. The gas generator composition as set forth in claim 2, further including a combustion controller with catalytic function, said controller including at least one compound selected from the group consisting of titanium oxide ($TiO_2$), copper oxide (CuO), zinc oxide (ZnO), manganese dioxide ($MnO_2$), iron chloride ($FeCl_3$), and manganese sulfate ($MnSO_4$).

4. A gas generator composition comprising: hydrazodicarbonamide serving as a reducing agent for generating a gas when oxidized, said hydrazodicarbonamide ranging from 10 to 42% by weight;

oxoacid salt serving as an oxidizing agent for oxidizing the reducing agent, said oxoacid salt ranging from 87 to 55% by weight;

a flame coolant containing at least one compound selected from the group consisting of hydrates of metal sulfates, hydrates of metal nitrates, metal carbonates, hydrates of metal carbonates, metal hydroxides and hydrates of metal hydroxides, in which the metal moiety is selected from the III, IV, V and VI Period metals of the Periodic Table, said time coolant ranging from 3 to 35% by weight;

a combustion controller with catalytic function containing at least one compound selected from the group consisting of titanium oxide ($TiO_2$), copper oxide (CuO), zinc oxide (ZnO), manganese dioxide ($MnO_2$), iron chloride ($FeCl_3$) and manganese sulfate ($MnSO_4$);

a combustible combustion controller containing at least one element selected from the group consisting of boron aluminum and zirconium; and said combustion controller ranging from 0.1 to 5% by weight.

5. The gas generator composition as set forth in claim 4, wherein said flame coolant contains an element of metal selected from the group consisting of aluminum (Al), copper (Cu), iron (Fe), manganese (Mu), magnesium (Mg), nickel (Ni), tin (Sn) and zinc (Zn).

6. The gas generator composition as set forth in claim 5, wherein said flame coolant contains hydroxide of said metal or hydrate of hydroxide of said metal.

7. The gas generator composition as set forth in claim 6, wherein the total content of said combustion controller with catalytic function and said combustible combustion controller is in the ranges from 0.1 to 5% by weight.

8. The gas generator composition as set forth in claim 7, wherein the combustion temperature of the gas generator composition is in the range of 1300° to 1500° C.

9. The gas generator composition as set forth in claim 8, wherein the volume of gas generated by the combustion of said gas generator composition is in the range from 0.4 to 0.55 litters per gram.

10. A gas generator composition comprising:

hydrazodicarbonamide serving as a reducing agent for generating a gas when oxidized, said hydrazodicarbonamide ranging from 10 to 42% by weight;

oxoacid salt serving as an oxidizing agent for oxidizing the reducing agent, said oxoacid salt ranging from 87 to 55% by weight;

a flame coolant containing at least one compound selected from the group consisting of hydrates of metal sulfates, hydrates of metal nitrates, metal carbonates, hydrates of metal carbonates, metal hydroxides and hydrates of metal hydroxides, in which the metal moiety is selected from the III, IV, V and VI Period metals of the Periodic Table, said flame coolant ranging from 3 to 35% by weight;

a combustible combustion controller containing at least one element selected from the group consisting of boron, aluminum and zirconium; and said combustible combustion controller ranging from 0.1 to 5% by weight.

* * * * *

UNITED STATES PATENT AND TRADEMARK OFFICE
CERTIFICATE OF CORRECTION

PATENT NO. : 5,656,793

DATED : August 12, 1997

INVENTOR(S) : Koji OCHI et al.

It is certified that error appears in the above-identified patent and that said Letters Patent is hereby corrected as shown below:

On the title page, Item "[73] Assignee:": Insert "NOF Corporation, Tokyo, Japan" before --Eiwa Chemical Ind. Co., Ltd., Kyoto, Japan--.

Signed and Sealed this

Sixteenth Day of June, 1998

*Attest:*

Bruce Lehman

BRUCE LEHMAN

*Attesting Officer*

*Commissioner of Patents and Trademarks*